US005095790A

United States Patent [19]

Pattillo

[11] Patent Number: 5,095,790

[45] Date of Patent: Mar. 17, 1992

[54] SAW BLADE FOR CUTTING BREAD AND PROCESS OF USING THE SAME

[75] Inventor: David B. Pattillo, Marietta, Ga.

[73] Assignee: Southern Saw Service, Inc., Atlanta, Ga.

[21] Appl. No.: 283,288

[22] Filed: Dec. 12, 1988

Related U.S. Application Data

[63] Continuation of Ser. No. 125,699, Nov. 27, 1987, abandoned.

[51] Int. Cl.[5] ..... B26D 1/46; B27B 33/06

[52] U.S. Cl. ..... 83/13; 83/661; 83/835

[58] Field of Search ..... 30/355, 357; 83/661, 83/837, 835, 846, 847, 788, 13, 56

[56] References Cited

U.S. PATENT DOCUMENTS

| | | | |
|---|---|---|---|
| 1,838,785 | 12/1931 | Overstreet | 83/661 |
| 2,596,851 | 5/1952 | Hansen | 83/846 |
| 2,757,697 | 8/1956 | Simmons et al. | 83/661 |
| 2,827,091 | 3/1958 | Metz | 83/661 |
| 3,132,677 | 5/1964 | Dunn | 83/661 |

FOREIGN PATENT DOCUMENTS

| | | | |
|---|---|---|---|
| 459574 | 9/1913 | France | 83/847 |

*Primary Examiner*—Frank T. Yost
*Assistant Examiner*—Eugenia A. Jones
*Attorney, Agent, or Firm*—Hopkins & Thomas

[57] ABSTRACT

A uniform width of steel forms a continuous band saw blade, the cutting edge of which has uniform lengths having smooth straight knife like cutting edges and other lengths which have three to eight teeth between the adjacent ends of the smooth knife like cutting edges. The blade is used for cutting bread.

13 Claims, 1 Drawing Sheet

SAW BLADE FOR CUTTING BREAD AND PROCESS OF USING THE SAME

This is a continuation of co-pending application Ser. No. 07/125,699 filed on 11/27/87 and now abandoned.

BACKGROUND OF THE INVENTION

This invention relates to saw blades and is more particularly related to saw blades for cutting bread and to the process of using the same.

In the past, blades having teeth along one side have been used for slicing loaves of bread and for slicing various forms of buns which are then packaged in a sliced or partially sliced condition. Usually, in cutting the buns, such buns are disposed in two longitudinal rows and are cut inwardly from opposite sides to leave the innermost portion of each bun uncut and joined to some of the other buns in the package.

Such prior art blades have usually been band saw blades with equally spaced teeth along their cutting edges. The teeth of such blades have been sharpened from one side so as to reduce the tendency of the blade to tear the bun as it cuts into the bun. Such cutting tears portions of the bread from the bun to produce crumbs of bread which are known in the trade as "snow". The toothed blade also tends to cut the bun so as to leave the interior of the buns in a torn, uneven condition, providing irregular cut surfaces.

Efforts have been made to reduce the generating of the snow by using sharp knife like band saw blades. Such knife like blades, however, tend to deform the shape of the bun and with certain types of buns, does not cut the bun well.

As a result of this problem with cutting bread, many loaves of bread cannot be satisfactorily cut into very thin slices.

The need for a blade which will slice bread without appreciably tearing or deforming the bread has existed for a long period of time.

SUMMARY OF THE INVENTION

Briefly described, the blade of the present invention has a conventional blade body; the cutting edge portion, however, has successive lengths of alternately a smooth knife like cutting edge and a serrated or scalloped, tooth portion having a few spaced teeth. The knife edge is from about four inches (10 millimeters) to about ten inches (25 millimeters) in length and the serrated or scalloped tooth portion has from about three to about eight cutting teeth.

The blade is preferably a continuous band saw blade which is installed in a conventional band saw for cutting bread, i.e., loaves of bread or buns. When urged into the bread, the blade quite readily makes the initial cut, due to the teeth of the scalloped portion and thereafter cuts quite smoothly and evenly, due to the synergesic cooperation between the smooth straight knife edge portion of the blade and the teeth.

Accordingly, it is an object of the present invention to provide a saw blade for cutting bread which will provide a smooth uniform cut and reduce substantially the amount of crumbs or "snow" which are generated from the cut.

Another object of the present invention is to provide a saw blade for cutting bread which is inexpensive to manufacture, durable in structure and efficient in operation.

Another object of the present invention is to provide an apparatus and process for cutting soft material, such as buns or loaves of bread which will provide a superior cut so that the sliced surface of the soft material is quite smooth and flat, without appreciable tears.

Another object of the present invention is to provide an apparatus and proces for slicing bread, such as loaves and buns, which will reduce to a minimum the losses due to crumbs or "snows" and enables the bread to be sliced into very thin slices.

Another object of the present invention is to provide a saw blade for cutting soft material, such as bread, which blade will stay sharp for an extended period of time.

Other objects, features and advantages of the present invention will become apparent from the following description when considered in conjunction with the accompanying drawings, wherein like characters of reference designate corresponding parts throughout the several views.

DETAILED DESCRIPTION

Figure 1:
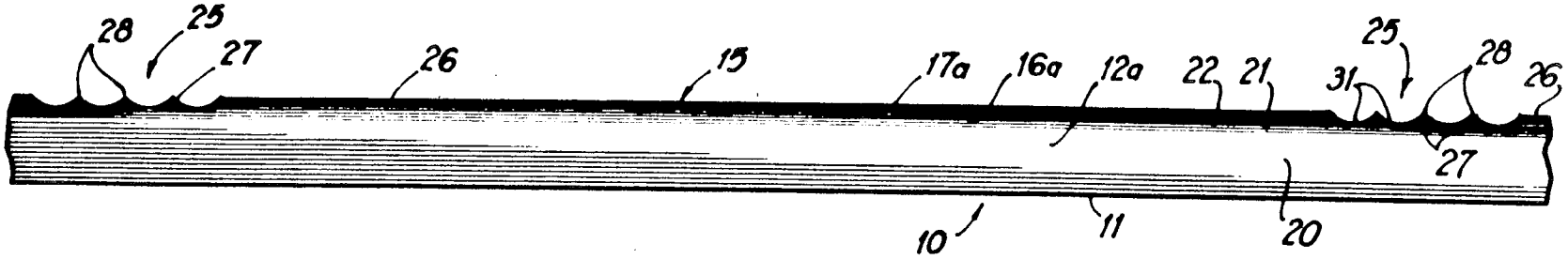
FIG. 1 is a fragmentary side elevational view of a portion of a band saw blade constructed in accordance with the present invention.
Figure 4:
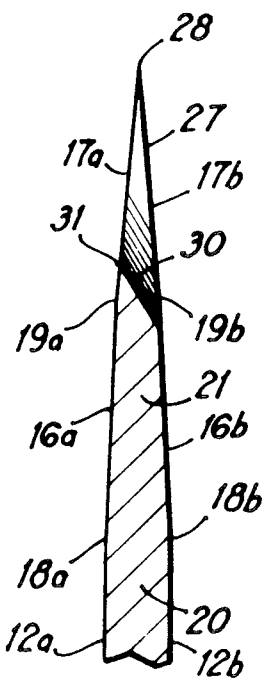
FIG. 4 is a cross-sectional view taken substantially along line 4—4 in FIG. 2.
Figure 3:
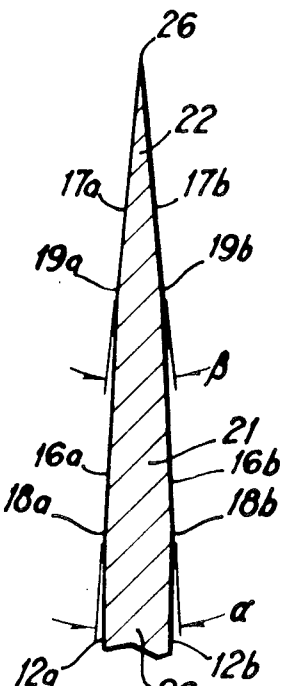
FIG. 3 is a cross-sectional view taken substantially along line 3—3 in FIG. 2.
Figure 2:
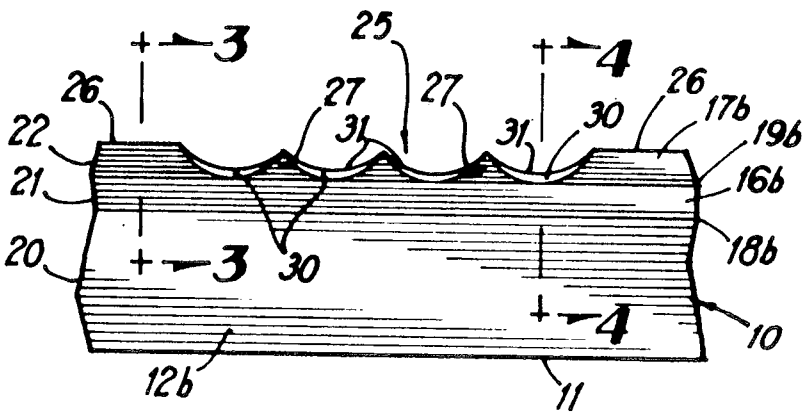
FIG. 2 is an enlarged fragmentary side elevational view of a portion of the other side of the blade shown in FIG. 1.

Referring now in detail to the embodiment chosen for the purpose of illustrating the present invention and for illustrating the best mode contemplated by me for carrying out the present invention, numeral 10 denotes generally a band saw blade which is composed of conventional steel having sufficient flexibility to pass around the opposed wheels which support the continuous blade 10 on a conventional band saw (not shown). The blade 10 has a thickness of 0.012 inch to 0.016 inchand preferrably 0.014 inch.

Blade 10 is generally rectangular in cross section, having the usual straight back edge 11 and flat, opposed, parallel rear side surface 12 and **12*b* which extend forwardly from the back edge 11**.

The front edge portion of the blade 10 tapers forwardly to a sharp fine front edge, denoted generally by numeral 15. This taper begins gradually, to provide a pair of flat opposed intermediate side surfaces **16*a* and 16*b* which converge forwardly at an included angle of between about 5 degrees and about 10 degrees. From the intermediate side surfaces 16*a*, 16*b* the blade 10 tapers at a larger angle $\beta$ of between about 20 degrees and to about 25 degrees to provide the forward side surfaces 17*a* and 17*b* which converge to edge 15**.

The intermediate side surfaces **16*a* and 16*b* thus share common straight edges 18*a* and 18*b* with rear side surfaces 12*a* and 12*b*, respectively. Also, the intermediate side surfaces 16*a* and 16*b* share common straight edges 19*a* and 19*b*, respectively. The edges 11, 15, 18*a*, 18*b*, 19*a* and 19*b* are parallel to each other. The edges 18*a* and 18*b* are spaced forwardly of edge 11 by the same distance and the edges 19*a* and 19*b* are spaced forwardly of the edges 18*a* and 18*b*** by the same distance.

The thickness of back portion 20 of body 20 of blade 10, between the transversely opposed rear side surfaces 12*a* and 12*b* is uniform, while the thickness of the intermediate portion between surfaces 16*a*, 16*b* is tapered forwardly. The forward or edge portion 22 defined by surfaces 17*a*, 17*b* tapers toward the front edge 15, from intermediate portion 21.

According to the present invention, the forward edge portion 22 is provided, at evenly spaced intervals, with scalloped or serrated teeth portions, denoted generally by the numeral 25. Between each pair of adjacent scalloped or serrated portions 25, the edge 15 has a straight uniform knife like cutting edge 26. When a portion of the blade 10 is disposed in a flat condition these cutting edges 26 are in alignment with each other and are parallel to back edge 10.

Each scalloped or serrated portion 25 consists of a plurality of evenly spaced teeth 27 formed by successive concaved arcuate edges 31 which define the valleys 28 and adjacent of these edges 31 converge outwardly to form the tip 26 of each tooth 27. The radii R of each edge 31 is identical and is preferrably 0.156 inch, or 0.250 inch or 0.375 inch. The tooth depth d are preferrably 0.0625 inch, 0.085 inch or 0.095 inch for the respective thicknesses listed above. The ratio of tooth depth d to tooth radius R is from about 1:2 to about 1:5. The spacing between the teeth should be 0.25 inch, 0.375 inch or 0.50 inch respective for the listed thicknesses. The width of material, i.e., from rear edge 11 to front edge 15, preferrably are 0.375 inch, 0.438 inch, or 0.75 inch respective for the listed thickness.

The edges 31 between the tips of teeth 27 are sharpened from only one side, so that each of the arcuate edges 31 is provided with a crescent shaped beveled surface 30.

The tips 28 of the teeth 27 are in the same plane with edges 26 and are in alignment with each other and in alignment with knife edge 26. The knife edge 26 should be from about 4 inches to about 10 inches in length and the scalloped or serrated portion 25 of the blade 10 should be from about 0.750" to about 2.0" and have from about three teeth 27 to about eight teeth. Preferably each scalloped portion should have four teeth 27.

The blade 10 is used by being placed adjacent to the bread and where either the bread or the blade is moved so as to move the blade, cutting edge first in a plane parallel to the blade into the bread. When cutting buns, the waste due to crumbs or "snow" is reduced by about 90% as compared to blades which are currently being sold for cutting buns. Cutting loaves of bread, using the blade 10 reduces the crumbs or "snow" by about 50%.

The teeth 27 should not protrude to any appreciable extent beyond knife edge 26 or to be recessed appreciably inwardly of the edge 26, the tips 28 being located sufficiently to begin the cut when a bun is initially engaged and provides for a substantial portion of the progressive cutting of the bun, aided by the knife edges 26 which functions to both cut and smooth down the sliced surface of the bun as it is cut. Thus, the resulting cut bun has a cut surface which has been termed "smooth as glass".

The friction on the blade 10 is reduced, due to the alternate scalloped and knife edge portions. The blade therefore stays sharp for extended periods of time, thereby increasing the useful life of the blade 10.

The double beveled blade 10, i.e., the blade with two angles for the bevel surface, progressively and gradually urges the bun open as a slice is made, the change in angle enabling the bun to be held partially open by the blade 10, as the cut progresses, the blade width being insufficient to cause appreciable tearing of the bun.

The inventive concept of the present invention is not limited to band saw blades, but can be utilized on other saw blades, if desired.

It would be obvious to those skilled in the art that many variations may be made in the embodiment chosen for the purpose of illustrating the present invention, without departing from the scope thereof as defined by the appended claims.

I claim:

1. Process of cutting bread having a crust comprising the steps of:

(a) disposing a prescribed amount of bread in a prescribed position;

(b) disposing a band saw blade having a flat body with spaced smooth straight knife cutting front edge portions separated by indented scalloped portions, adjacent to said bread, said indented scalloped portions each having a plurality of spaced teeth within the indented portions, said teeth protruding forwardly from said body, said teeth being spaced from each other and from the ends of said knife cutting front edge portions, said teeth having spaced tips which are generally in alignment with said front edge portions; and (c) causing movement of said blade along a path of travel and also relative movement between said blade and said bread in a plane parallel to said body for producing a smooth cut in said bread.

2. A band saw blade comprising:

a flat, flexible, continuous body provided with a front edge portion having scalloped portions forming recesses at spaced intervals along said front edge portion, said front edge portion also being provided with sharp straight knife cutting edges at other intervals along said edge portion, said knife cutting edges being respectively disposed between adjacent scalloped portions, said knife cutting edges being within the plane of said body, spaced successive outwardly protruding cutting teeth within each of said scalloped portions, each tooth being integrally connected to said body by its base and being formed by an adjacent pair of tooth edges extending from said body and converging toward each other to respectively terminate in spaced successive tips in alignment along the length of said blade with said knife cutting edges for cooperating with said knife cutting edges when said blade is cutting bread having a crust so that the bread and crust are cut alternately by said knife cutting edges and by said tips of said teeth and whereby the bread and crust are smoothly sliced without the generation of appreciable crumbs.

3. The saw blade defined in claim 2 wherein portions of said blade are tapered toward said knife cutting edges and also tapered toward the tips of said teeth.

4. The saw blade defined in claim 2 wherein said tooth edges are arcuate edges and the ratio of the depth of said teeth to the radius of said teeth edges is between about 1:2 to 1:5.

5. The saw blade defined in claim 2 wherein each tip of each tooth tapers to essentially a point.

6. The saw blade defined in claim 2 wherein each tooth has a concaved leading edge and a concaved trailing edge.

7. The saw blade defined in claim 6 wherein each of said concaved portions is bevelled to a sharp edge on only one side.

8. The saw blade defined in claim 2 wherein said teeth are defined by spaced concaved portions bevelled on only one side and wherein the straight edge portions and teeth are sharpened from both sides of the blade.

9. The saw blade defined in claim 2 wherein said teeth portions are between approximately 0.750 inch and approximately two inches in length and wherein said knife cutting edges are each between approximately four and approximately ten inches in length.

10. The saw blade defined in claim 2 wherein said teeth portions have arcuate edges and the ratio of the depth of said teeth to the radius of said arcuate edges is between about 1:2 to about 1:5.

11. A band saw blade for being moved along a continuous path of travel, said blade being of the type having a blade body provided with a front cutting edge for slicing bread having a crust thereon, the improvement comprising said front cutting edge being defined by:

(a) a plurality of straight, smooth, sharp, knife cutting edge portions which during cutting are successively aligned with a portion of said path of travel, the ends of adjacent of said knife cutting edge portions being spaced from each other; and (b) a plurality of teeth portions respectively disposed between said ends of said knife cutting edge portions, each of said teeth portions being provided with a plurality of successive outwardly tapered teeth, recessed into said body and terminating in tips spaced from each other in each of the teeth portions and also spaced from the adjacent ends of said knife cutting edge portions, the tips being in about a common plane with each other and with said body, the length of each of said knife cutting edge portions being substantially longer than the length of said teeth portions.

12. The saw blade defined in claim 11 wherein each of said teeth portions has from approximately three to approximately eight teeth.

13. The saw blade defined in claim 11 wherein side portions of said blade are tapered toward said knife cutting edges and toward the tips of said teeth.

* * * * *